US006208228B1

(12) United States Patent
Gula et al.

(10) Patent No.: US 6,208,228 B1
(45) Date of Patent: Mar. 27, 2001

(54) CIRCUIT INTERRUPTER WITH IMPROVED TRIP BAR ASSEMBLY ACCOMODATING INTERNAL SPACE CONSTRAINTS

(75) Inventors: Lance Gula, Clinton; Mark Anthony Janusek, Pittsburgh; Richard Paul Malingowski, Finleyville, all of PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 09/505,410

(22) Filed: Feb. 16, 2000

(51) Int. Cl.[7] ..... H01H 9/00
(52) U.S. Cl. ..... 335/172; 335/132; 335/202
(58) Field of Search ..... 335/167–176, 335/23–25, 132, 202; 200/293–308

(56) References Cited

U.S. PATENT DOCUMENTS 3,973,230 * 8/1976 Ciarcia et al. ..... 335/173
4,503,408 * 3/1985 Mrenna et al. ..... 335/35
5,469,121 * 11/1995 Payet-Burin ..... 335/16
5,479,143 * 12/1995 Payet-Burin ..... 335/202
5,581,219 * 12/1996 Nozawa et al. ..... 335/132
5,831,499 * 11/1998 Batteux et al. ..... 335/9
5,986,225 * 11/1999 Castonguay et al. ..... 200/308

* cited by examiner

*Primary Examiner*—Lincoln Donovan
*Assistant Examiner*—Tuyen T. Nguyen
(74) *Attorney, Agent, or Firm*—Charles E. Kosinski

(57) ABSTRACT

A circuit interrupter including a housing, separable main contacts within the housing, and an operating mechanism within the housing and interconnected with the contacts. A trip mechanism is disposed within the housing and includes a rotatable trip bar assembly that, when selectively rotated, generates a tripping operation. The trip bar assembly includes an attaching structure which interconnects with an accessory trip member. The accessory trip member causes the trip bar assembly to rotate and generate a tripping operation when the accessory trip member is moved in a first direction. The accessory trip member is configured to enable flexing of the accessory trip member in a second direction opposite of the first direction.

10 Claims, 11 Drawing Sheets

CIRCUIT INTERRUPTER WITH IMPROVED TRIP BAR ASSEMBLY ACCOMODATING INTERNAL SPACE CONSTRAINTS

BACKGROUND OF THE INVENTION

1. Field of the Invention

The present invention relates to circuit interrupters generally and, more specifically, to those kinds of circuit interrupters having a trip bar assembly that rotates during a tripping operation.

2. Description of the Prior Art

Molded case circuit breakers and interrupters are well known in the art as exemplified by U.S. Pat. No. 4,503,408 issued Mar. 5, 1985, to Mrenna et al., and U.S. Pat. No. 5,910,760 issued Jun. 8, 1999 to Malingowski et al., each of which is assigned to the assignee of the present application and incorporated herein by reference.

A continuing industry objective with respect to many types of circuit interrupters is to be able to reduce the size and/or footprint of the interrupter housing while at the same time providing the same or improved performance capabilities. A major advantage of creating such a "smaller package" is that it provides increased flexibility in installation. However, a consequence of this objective is that the internal space constraints of such interrupters have become much more limiting, posing certain design obstacles that need to be overcome.

Circuit interrupters include trip mechanisms that can be activated in a variety of manners so as to set in motion a tripping operation to open the contacts of the interrupter. These trip mechanisms often employ a rotatable trip bar assembly that, when selectively rotated, releases a portion of the operating mechanism to thereby generate a tripping operation.

Such circuit interrupters advantageously provide for automatic circuit interruption that causes the trip bar assembly to rotate when an overcurrent condition is sensed. This automatic interruption may be thermally, magnetically, or otherwise based. In addition, such circuit interrupters often enable a tripping operation to be manually initiated by implementation of a push-to-trip member which, when pressed, contacts and rotates the trip bar assembly.

Circuit interrupters may also advantageously have accessory devices, such as an undervoltage release (UVR) or a shunt trip, connected thereto. Such accessory devices can likewise initiate a tripping operation, and typically do so by contacting and rotating an accessory trip lever on the trip bar assembly that then causes the trip bar assembly to rotate. However, because of the required positioning and size of such an accessory trip lever, the lever sweeps through a relatively large range of motion within the circuit interrupter whenever any type of tripping operation occurs. Therefore, it is difficult to employ such an accessory trip lever within a circuit interrupter having the aforementioned internal space constraints. Internal components of such a circuit interrupter may obstruct the rotational movement of the accessory trip lever and undesirably prevent the trip bar assembly from sufficiently rotating in certain circumstances.

One problem associated with accessory trip lever obstruction is encountered when a bimetal is used to implement a thermal tripping operation. The bimetal reacts to current flowing therethrough, with the temperature of the bimetal being proportional to the current magnitude. As current magnitude increases, the heat buildup in the bimetal has a tendency to cause a bottom portion thereof to deflect (bend).

When non-overcurrent conditions exist, this deflection is minimal. However, above a predetermined current level, the temperature of the bimetal will exceed a threshold temperature whereby the deflection causes the bottom portion to make contact with a thermal trip member of the trip bar assembly. This contact forces the trip bar assembly to rotate and generate a tripping operation.

Under certain circumstances, such as a short circuit condition or the presence of excessively high currents, the bimetal can quickly heat up to a higher temperature, causing the bimetal to deflect faster and to a greater extent than normal under overcurrent conditions. This enhanced deflection has a tendency to cause greater rotation of the trip bar assembly than what is necessary in order to generate a tripping operation, the movement of which can be hindered by the aforementioned obstruction of an accessory trip lever. Unfortunately, by preventing the trip bar assembly from continuing to rotate in this situation, an obstruction can prevent the bimetal from fully and properly deflecting, thereby undesirably causing the bimetal to "take a set." Such an event can destroy the calibration of the bimetal and prevent it from being properly calibrated thereafter.

Therefore, it would be advantageous if a way existed by which an accessory device tripping operation could be conveniently and effectively implemented within a circuit interrupter having internal space constraints. In particular, it would be advantageous if a way existed by which to accommodate for an aforementioned obstruction of an accessory trip lever while, at the same time, enabling the trip bar assembly to continue to rotate during a tripping operation.

SUMMARY OF THE INVENTION

The present invention provides a circuit interrupter that meets all of the above-identified needs.

In accordance with the present invention, a circuit interrupter is provided which includes a housing, separable main contacts within the housing, and an operating mechanism within the housing and interconnected with the separable main contacts. A trip mechanism is disposed within the housing and includes a rotatable trip bar assembly that, when selectively rotated, generates a tripping operation causing the operating mechanism to open the contacts. The trip bar assembly includes an attaching structure which interconnects with an accessory trip member. The accessory trip member causes the trip bar assembly to rotate and generate a tripping operation when the accessory trip member is moved in a first direction. The accessory trip member is configured to enable flexing of the accessory trip member in a second direction opposite of said first direction.

This and other objects and advantages of the present invention will become apparent from a reading of the following description of the preferred embodiment taken in connection with the attached drawings.

DESCRIPTION OF THE PREFERRED EMBODIMENT

Figure 1:
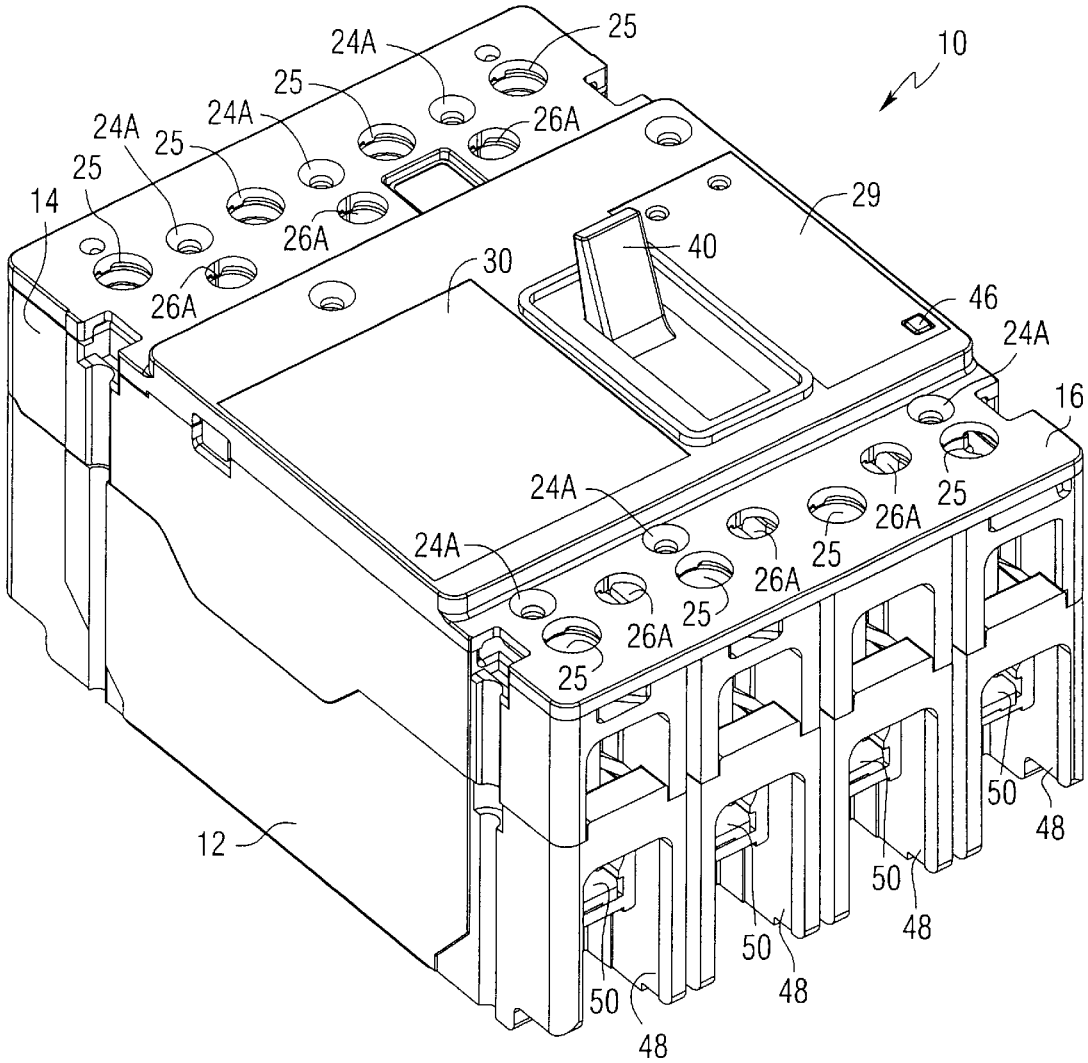
FIG. 1 is an orthogonal view of a molded case circuit interrupter embodying the present invention.
Figure 2:
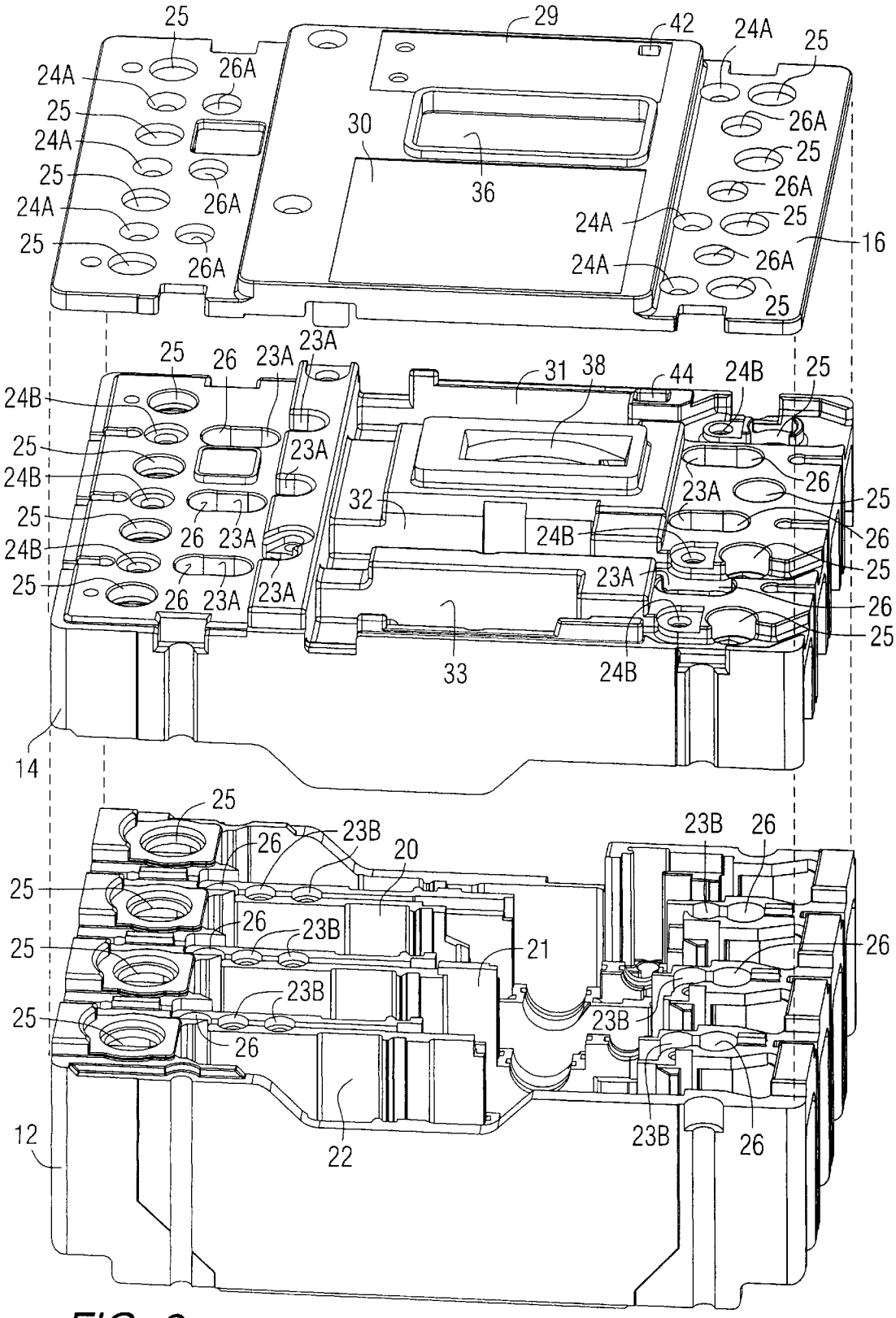
FIG. 2 is an exploded view of the base, primary cover, and secondary cover of the circuit interrupter of FIG. 1.

Referring now to the drawings and FIGS. 1 and 2 in particular, shown is a molded case circuit interrupter or breaker 10. A detailed description of the general structure and operation of circuit beaker 10 can be found in U.S. patent application Ser. No. 09/386,126, the disclosure of which is incorporated herein by reference. Briefly, circuit breaker 10 includes a base 12 mechanically interconnected with a primary cover 14. Disposed on top of primary cover 14 is an auxiliary or secondary cover 16. When removed, secondary cover 16 renders some internal portions of the circuit breaker available for maintenance and the like without requiring disassembly of the entire circuit breaker. Base 12 includes internal phase walls 20, 21, and 22. Holes or openings 23A are provided in primary cover 14 for accepting screws or other attaching devices that enter corresponding holes or openings 23B in base 12 for fastening primary cover 14 to base 12. Holes or openings 24A are provided in secondary cover 16 for accepting screws or other attaching devices that enter corresponding holes or openings 24B in primary cover 14 for fastening secondary cover 16 to primary cover 14. Holes 25, which feed through secondary cover 16, primary cover 14, and into base 12 (one side showing holes 25), are provided for access to electrical terminal areas of circuit breaker 10. Holes 26A, which feed through secondary cover 16, correspond to holes 26 that feed through primary cover 14 and base 12, and are provided for attaching the entire circuit breaker assembly onto a wall, or into a DIN rail back panel or a load center, or the like. Surfaces 29 and 30 of secondary cover 16 are for placement of labels onto circuit breaker 10. Primary cover 14 includes cavities 31, 32, and 33 for placement of internal accessories of circuit breaker 10. Secondary cover 16 includes a secondary cover handle opening 36. Primary cover 14 includes a primary cover handle opening 38. A handle 40 (FIG. 1) protrudes through openings 36 and 38 and is used in a conventional manner to manually open and close the contacts of circuit breaker 10 and to reset circuit breaker 10 when it is in a tripped state. Handle 40 may also provide an indication of the status of circuit breaker 10 whereby the position of handle 40 corresponds with a legend (not shown) on secondary cover 16 near handle opening 36 which clearly indicates whether circuit breaker 10 is ON (contacts closed), OFF (contacts open), or TRIPPED (contacts open due to, for example, an overcurrent condition). Secondary cover 16 and primary cover 14 include rectangular openings 42 and 44, respectively, through which protrudes a top portion 46 (FIG. 1) of a button for a push-to-trip actuator. Also shown are load conductor openings 48 in base 12 that shield and protect load terminals 50. Although circuit breaker 10 is depicted as a four phase circuit breaker, the present invention is not limited to four-phase operation.

Figure 3:
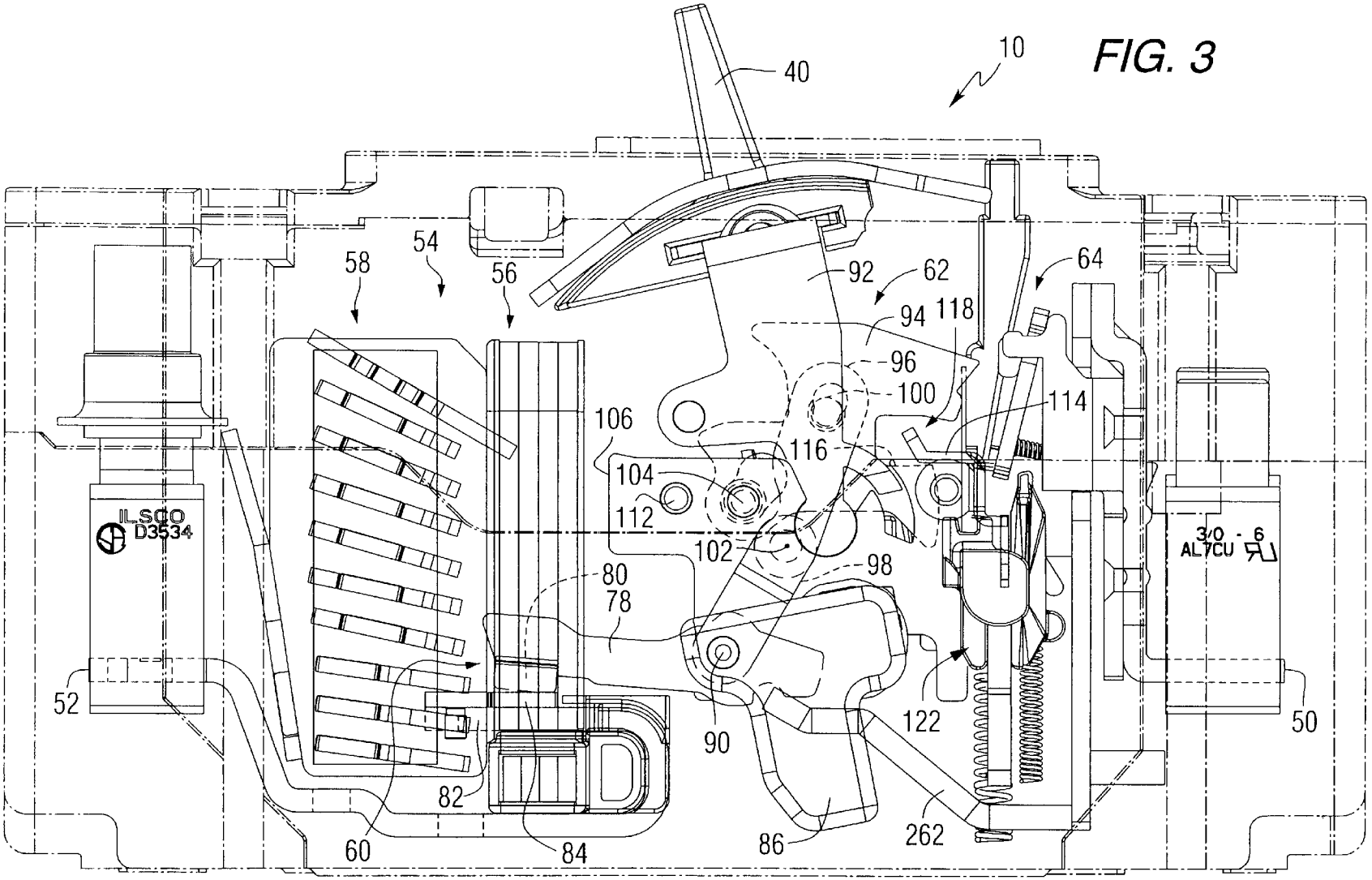
FIG. 3 is a side elevational view of an internal portion of the circuit interrupter of FIG. 1.

Referring now to FIG. 3, a longitudinal section of a side elevation, partially broken away and partially in phantom, of circuit breaker 10 is shown having a load terminal 50 and a line terminal 52. There is shown a plasma arc acceleration chamber 54 comprising a slot motor assembly 56 and an arc extinguisher assembly 58. Also shown is a contact assembly 60, an operating mechanism 62, and a trip mechanism 64 including a rotatable trip bar assembly 122. Although not viewable in FIG. 3, each phase of circuit breaker 10 has its own load terminal 50, line terminal 52, plasma arc acceleration chamber 54, slot motor assembly 56, arc extinguisher assembly 58, and contact assembly 60. Reference is often made herein to only one such group of components and their constituents for the sake of simplicity.

Each contact assembly 60 is shown as comprising a movable contact arm 78 supporting thereon a movable contact 80, and a stationary contact arm 82 supporting thereon a stationary contact 84. Each stationary contact arm 82 is electrically connected to a line terminal 52 and, although not shown, each movable contact arm 78 is electrically connected to a load terminal 50. Also shown is a crossbar assembly 86 which traverses the width of circuit breaker 10 and is rotatably disposed on an internal portion of base 12 (not shown). Actuation of operating mechanism 62 causes crossbar assembly 86 and movable contact arms 78 to rotate into or out of a disposition which places movable contacts 80 into or out of a disposition of electrical continuity with fixed contacts 84.

Operating mechanism 62 comprises a handle arm or handle assembly 92 (connected to handle 40), a configured plate or cradle 94, an upper toggle link 96, an interlinked lower toggle link 98, and an upper toggle link pivot pin 100 which interlinks upper toggle link 96 with cradle 94. Lower toggle link 98 is pivotally interconnected with upper toggle link 96 by way of an intermediate toggle link pivot pin 102, and with crossbar assembly 86 at a pivot pin 90. Provided is a cradle pivot pin 104 which is laterally and rotatably disposed between parallel, spaced apart operating mechanism support members or sideplates 106. Cradle 94 is free to rotate (within limits) via cradle pivot pin 104. A main stop bar 112 is laterally disposed between sideplates 106, and provides a limit to the counter-clockwise movement of cradle 94.

In FIG. 3, operating mechanism 62 is shown for the ON disposition of circuit breaker 10. In this disposition, contacts 80 and 84 are closed (in contact with each other) whereby electrical current may flow from load terminals 50 to line terminals 52.

Operating mechanism 62 will assume the TRIPPED disposition of circuit breaker 10 in certain circumstances. The TRIPPED disposition is related to an opening of circuit breaker 10 caused by a manual tripping operation, an accessory tripping operation (as described below), or the thermally or magnetically induced reaction of trip mechanism 64 to the magnitude of the current flowing between load conductors 50 and line conductors 52. A detailed description of the manual tripping operation and the automatic operation of trip mechanism 64 can be found in U.S. patent application Ser. No. 09/386,126. Whatever the nature of a tripping operation, it is initiated by a force causing trip bar assembly 122 to rotate clockwise (overcoming a spring force biasing assembly 122 in the opposite direction) and away from an intermediate latch 114. This unlocking of latch 114 releases cradle 94 (which had been held in place at a lower portion 116 of a latch cutout region 118) and enables it to be rotated counter-clockwise under the influence of tension springs (not shown) interacting between the top of handle assembly 92 and the intermediate toggle link pivot pin 102. The resulting collapse of the toggle arrangement causes pivot pin 90 to be rotated clockwise and upwardly to thus cause crossbar assembly 86 to similarly rotate. This rotation of crossbar assembly 86 causes a clockwise motion of movable contact arms 78, resulting in a separation of contacts 80 and 84.

Figure 4:
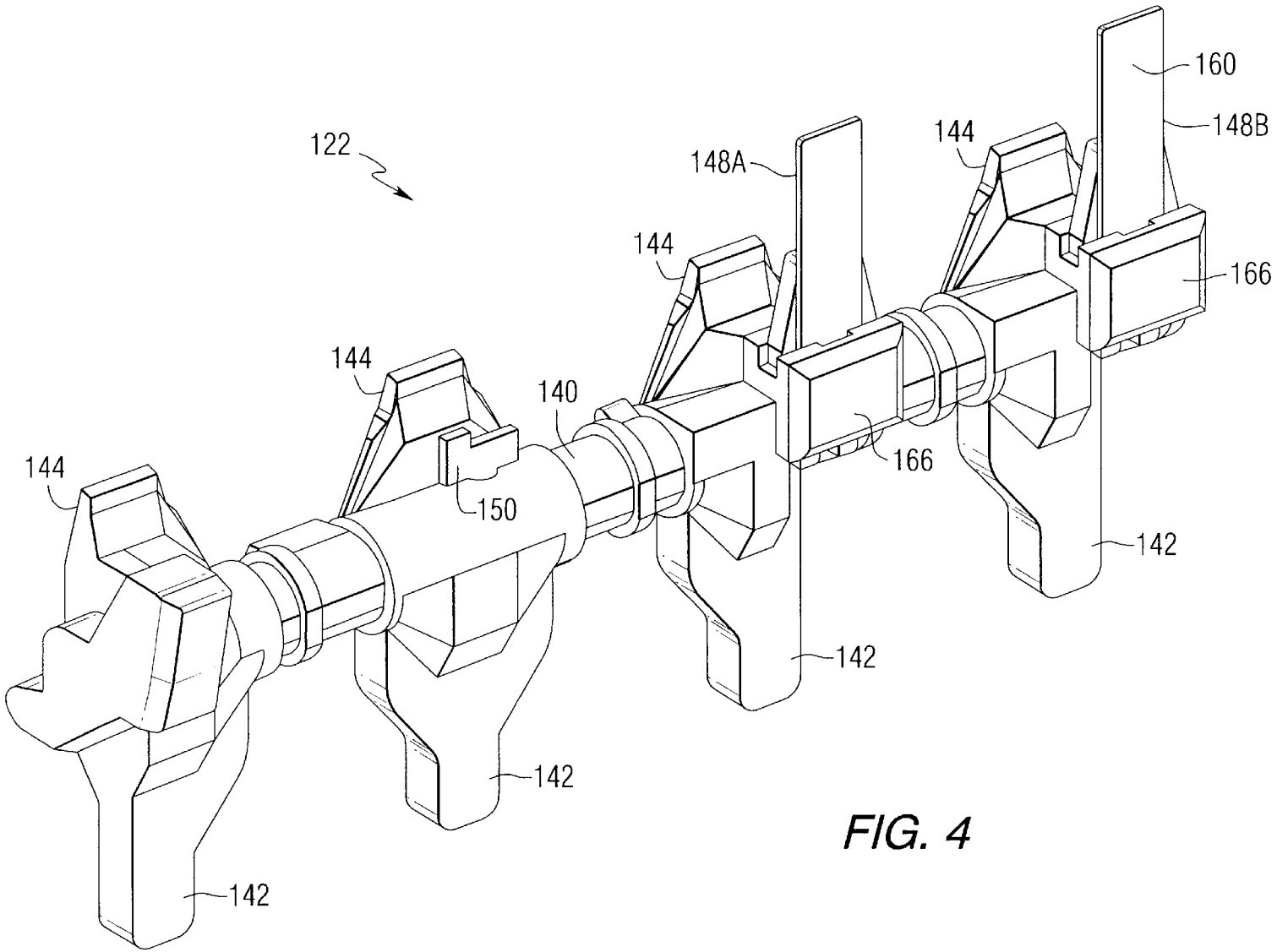
FIG. 4 is an orthogonal view of the trip bar assembly of the circuit interrupter of FIG. 1.
Figure 5:
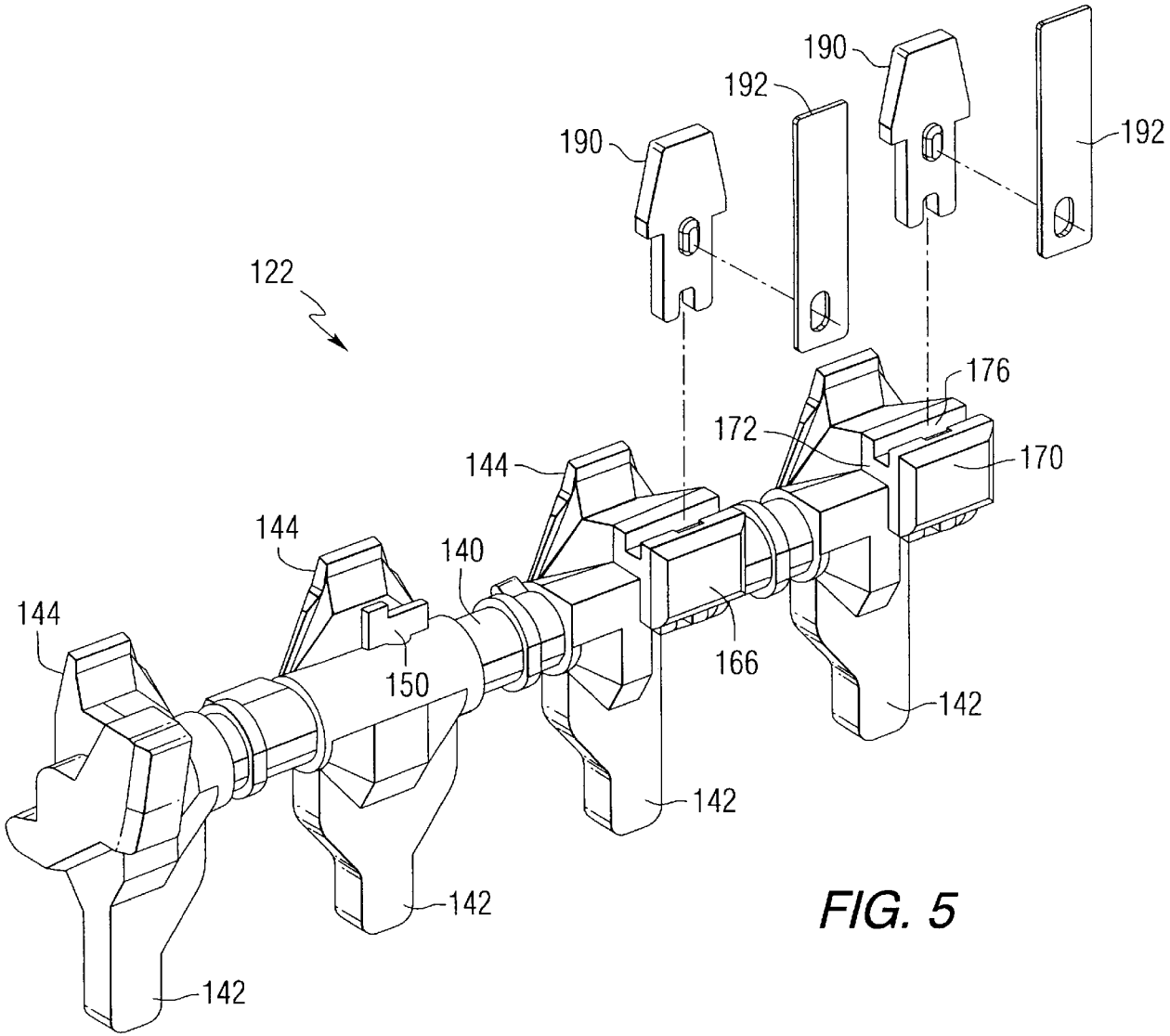
FIG. 5 is another orthogonal view of the trip bar assembly of the circuit interrupter of FIG. 1 showing how the accessory trip levers are inserted.

Referring now to FIGS. 4 and 5, shown is trip bar assembly 122 of trip mechanism 64 of the exemplary embodiment. Assembly 122 includes a trip bar or shaft 140 to which is connected thermal trip bars or paddles 142, magnetic trip bars or paddles 144, and accessory trip levers 148A and 148B. Trip bar assembly 122 also includes an intermediate latch interface 150 that locks with intermediate latch 114 (FIG. 3) when trip bar assembly 122 has not rotated clockwise during a tripping operation.

Circuit breaker 10 includes the ability to provide accessory tripping operations which can cause trip bar assembly 122 to rotate in the clockwise direction and thereby release cradle 94. Referring now briefly again to FIG. 2, primary cover 14 includes cavities 32 and 33 into which may be inserted internal accessories for circuit breaker 10. Examples of such conventional internal accessories include an undervoltage release (UVR), and a shunt trip. Each of cavities 32 and 33 includes a rightward opening (not shown) that provides access into base 12 and which faces trip mechanism 64. In particular, the opening within cavity 32 provides actuating access to accessory trip lever 148A, and the opening within cavity 33 provides actuating access to accessory trip lever 148B (see FIG. 4). When an appropriate accessory device, located in cavity 33 for example, operates in a conventional manner whereby it determines that a tripping operation of circuit breaker 10 should be initiated, a plunger or the like comes out of the device and protrudes through the rightward opening in cavity 33 and makes contact with a contact surface 160 of accessory trip lever 148B. This contact causes trip lever 148B to move to the right, thereby causing a clockwise (when viewed in FIG. 3) rotation of trip bar assembly 122 which leads to the TRIPPED disposition.

Internal components of circuit breaker 10, such as portions of primary cover 14, may obstruct the rotational movement of the top of an accessory trip lever 148 during clockwise rotation of trip bar assembly 122 during any type of tripping operation (push-to-trip, thermal, magnetic, etc.). This is especially true in a circuit breaker having internal space constraints. Such an obstruction can prevent lever 148 from continuing to rotate in the clockwise direction. In a manner described below, circuit breaker 10 of the present invention ensures that trip bar assembly 122 can continue to sufficiently rotate in the clockwise direction during a tripping operation notwithstanding such obstruction of an accessory trip lever 148.

Figure 6A:
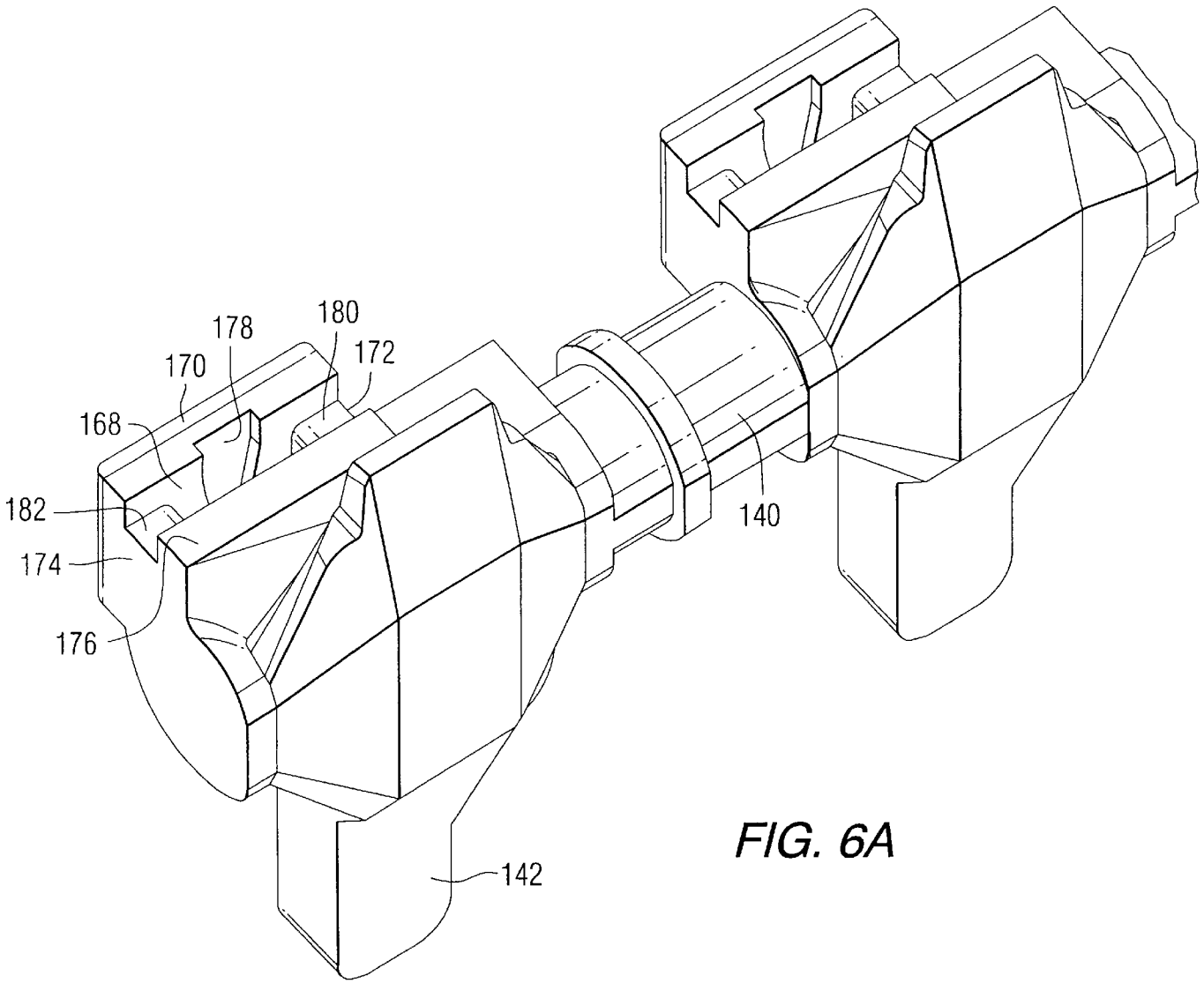
FIG. 6A is an orthogonal view of the attaching structures of the trip bar assembly of the circuit interrupter of FIG. 1.
Figure 6B:
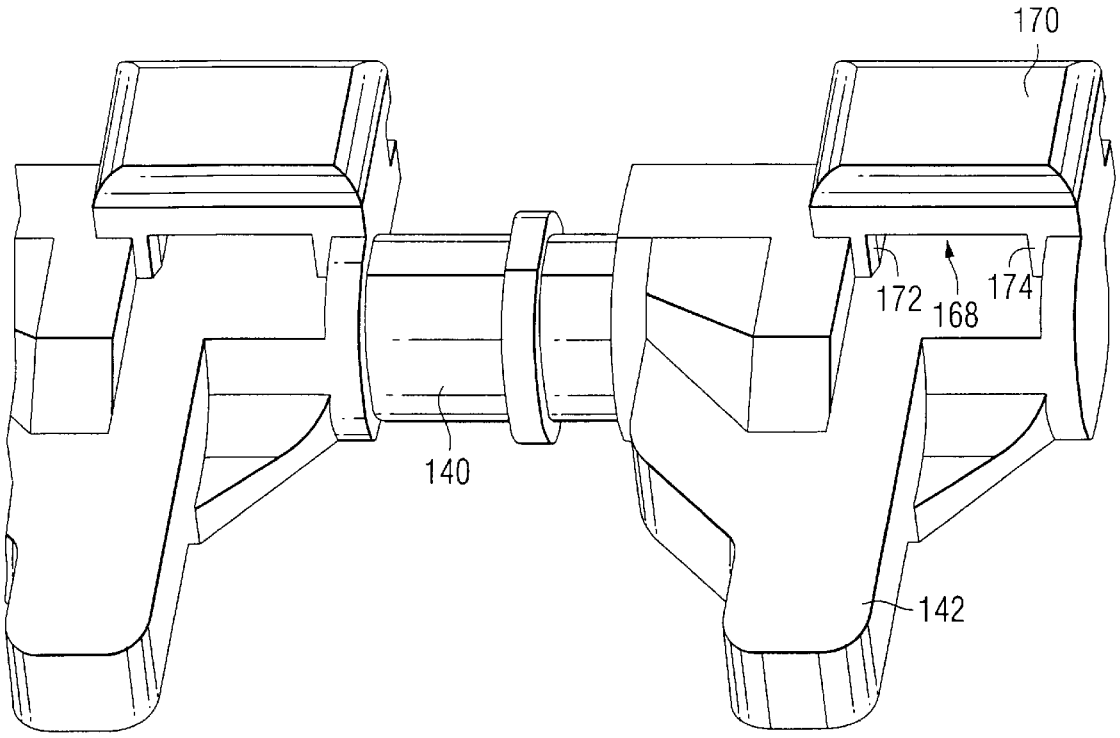
FIG. 6B is another orthogonal view of the attaching structures of the trip bar assembly of the circuit interrupter of FIG. 1.

Referring again to FIGS. 4 and 5, trip bar assembly 122 includes integrally molded attaching devices or structures 166 that connect accessory trip levers 148A and 148B to trip bar assembly 122. Referring now also to FIGS. 6A and 6B, each of the attaching structures 166 of the exemplary embodiment includes an open-ended cavity 168 defined by a front wall 170, sidewalls 172 and 174, and a backwall 176. For purposes described below, front wall 170 includes a groove 178 positioned within cavity 168 and extending from the top of wall 170 to a point above the bottom thereof (see FIG. 8). The tops of sidewalls 172 and 174 each define a shoulder 180 and 182, respectively, for purposes described below. The above-described configuration of attaching structure 166 can be advantageously molded into trip bar assembly 122 without complicated molding processes such as bypass molding or side pull molding.

Figure 7A:
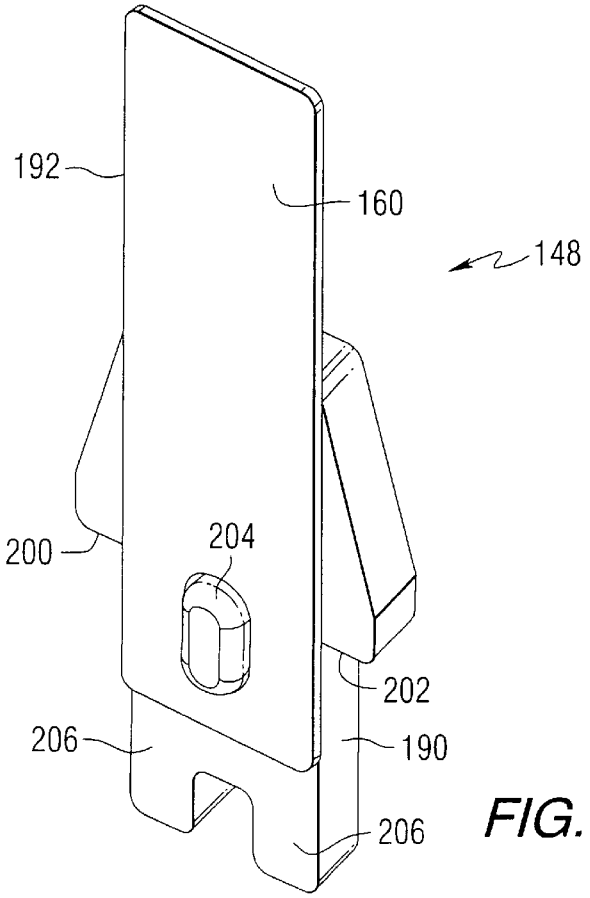
FIG. 7A is an orthogonal view of an accessory trip lever of the trip bar assembly of the circuit interrupter of FIG. 1.
Figure 7B:
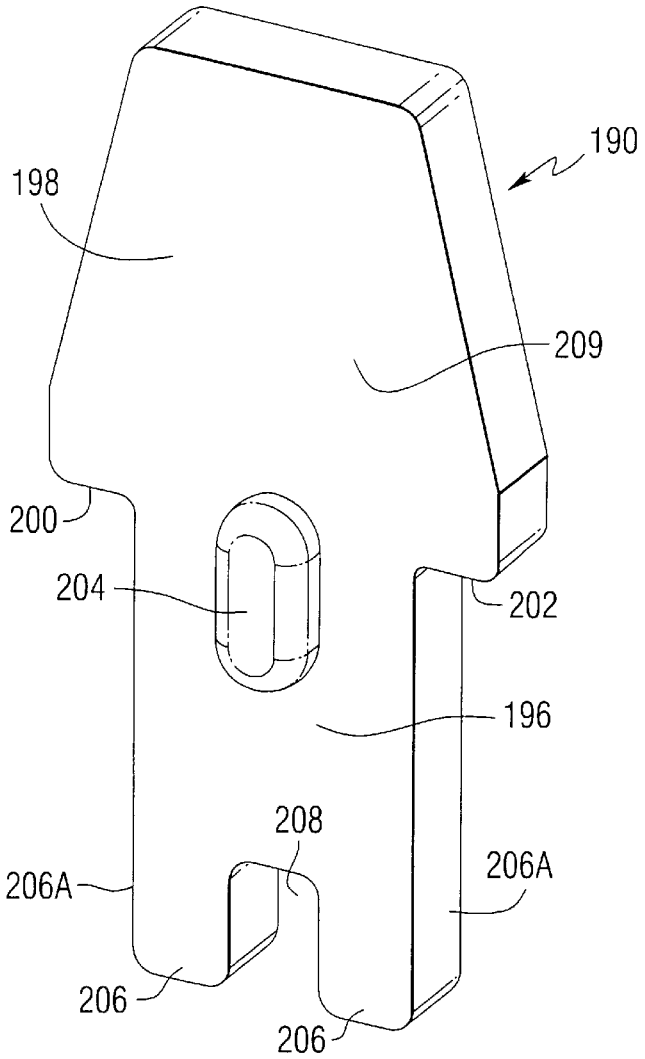
FIG. 7B is an orthogonal view of the lower lever portion of an accessory trip lever.
Figure 7C:
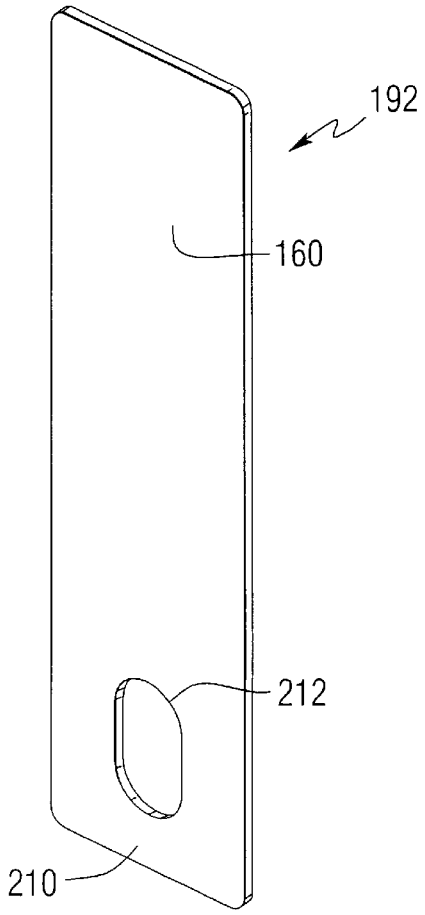
FIG. 7C is an orthogonal view of the upper lever portion of an accessory trip lever.

Now referring also to FIGS. 7A, 7B and 7C, shown is an accessory trip lever 148 of the exemplary embodiment. Accessory trip lever 148 is comprised of a lower lever portion or accessory lower lever 190, and an upper lever portion or accessory spring lever 192. As best seen in FIG. 7B, lower lever portion 190 includes a base 196 connected to a head 198 which defines abutment surfaces 200 and 202. Base 196 includes a protrusion 204 which, in the exemplary embodiment, is oval in shape. Also connected to base 196 are parallel legs 206 with a cutout 208 therebetween. Legs 206 have abutment regions 206A for purposes described below. Lower lever portion 190 also includes a front surface 209. In the exemplary embodiment, lower lever portion 190 is formed of cold-rolled steel of sufficient thickness so as to be substantially rigid.

As best seen in FIG. 7C, upper lever portion 192 of accessory trip lever 148 is rectangular in shape and includes a lower end region 210 through which extends an opening 212 that is sized and shaped to correspond to protrusion 204 of lower lever portion 190. Near its top, upper lever portion 192 includes a contact surface 160 (as described above). In the exemplary embodiment, upper lever portion 192 is formed of stainless spring steel having a thickness of approximately 0.010 inches, and is semi-flexible for reasons discussed below.

Accessory trip lever 148 is assembled by inserting protrusion 204 of lower lever portion 190 into opening 212 of upper lever portion 192 in the manner shown in FIG. 7A. In this configuration, the back surface of portion 192 contacts front surface 209 of portion 190, with contact surface 160 positioned above head 198 of portion 190. As shown in FIG. 7A, the width of base 196 of lower lever portion 190 is approximately the same as the width of upper lever portion 192.

Figure 8:
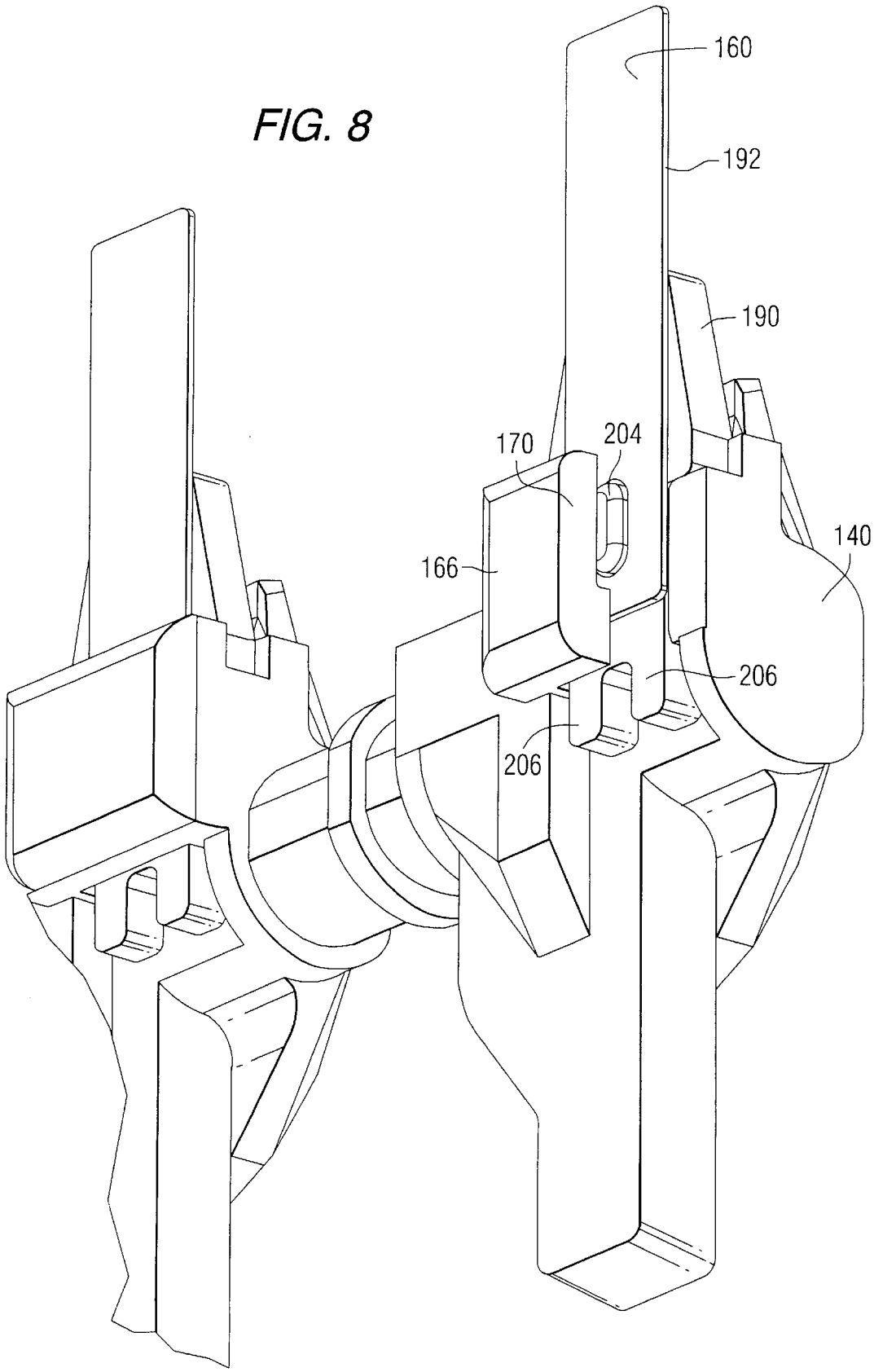
FIG. 8 is an orthogonal view of the trip bar assembly of the circuit interrupter of FIG. 1 depicting the insertion of an accessory trip lever.

Each of accessory trip levers 148A and 148B (assembled as shown in FIG. 7A) insert into attaching structures 166 in order to be connected to trip bar assembly 122. Referring now also to FIG. 8 wherein a portion of front wall 170 of attaching structure 166 is cut away for purposes of illustration, the insertion process begins with the insertion of legs 206 into cavity 168, and continues until abutment surfaces 200 and 202 abut shoulders 180 and 182, respectively. During this insertion, protrusion 204 of accessory trip lever 148 is channeled into groove 178 of front wall 170, resulting in the insertion of lower end region 210 of upper lever portion 192 within cavity 168 and the locking together of lower lever portion 190 and upper lever portion 192.

Figure 9:
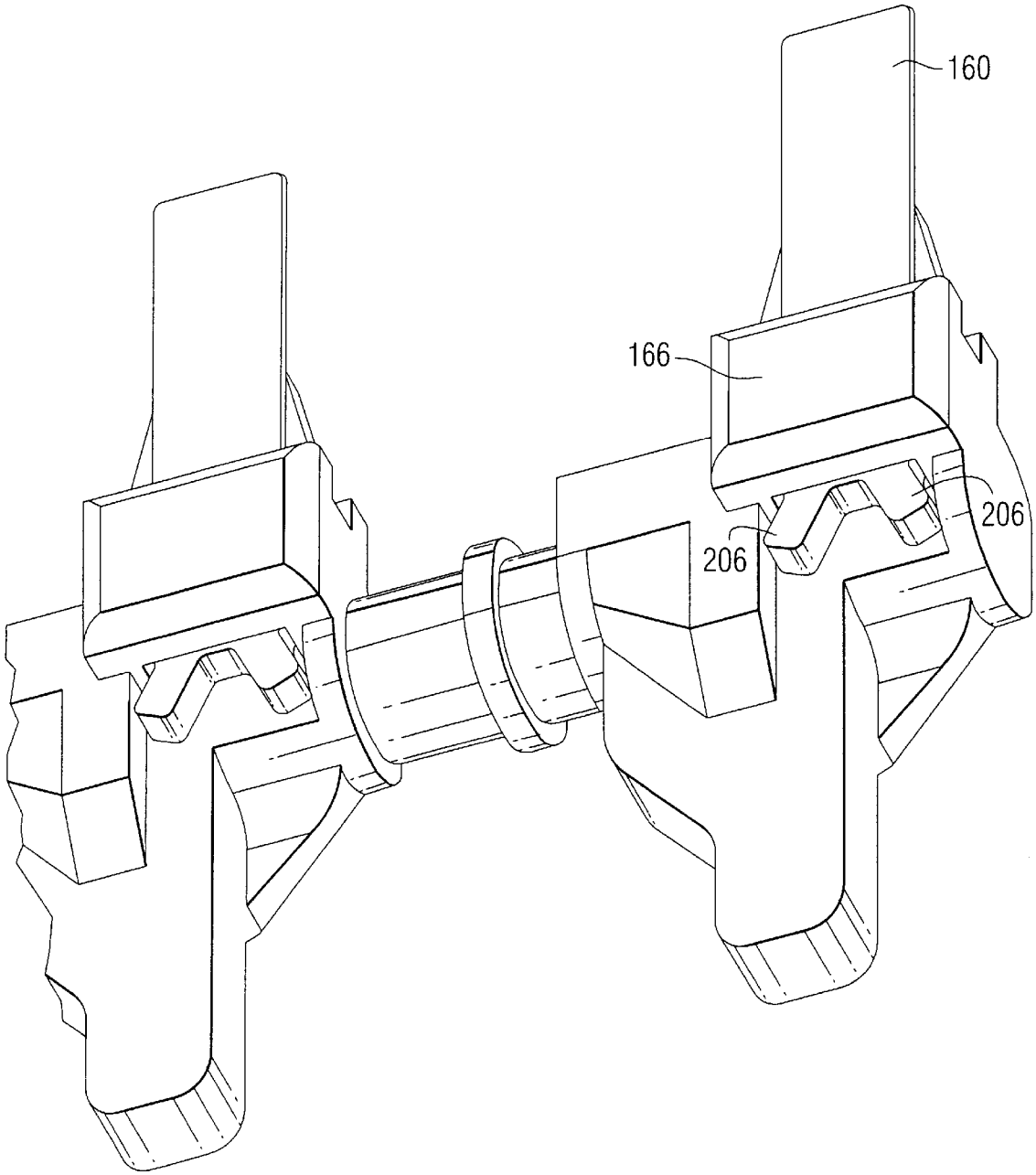
FIG. 9 is an orthogonal view depicting the locking in of an inserted accessory trip lever.

After insertion of an accessory trip lever 148 as described above, legs 206 of lower lever portion 190 protrude through the bottom of cavity 168, as shown in FIG. 8. Referring now also to FIG. 9, legs 206 are then bent outwards and away from each other until abutment regions 206A of legs 206 abut the bottoms of sidewalls 172 and 174 (see FIG. 6B), thereby vertically locking accessory trip lever 148 within cavity 168 and providing a secure engagement of lever 148 with trip bar assembly 122. In order to achieve the aforementioned separation of legs 206, an arbor press with a V-shaped mandrel may be used.

Figure 10A:
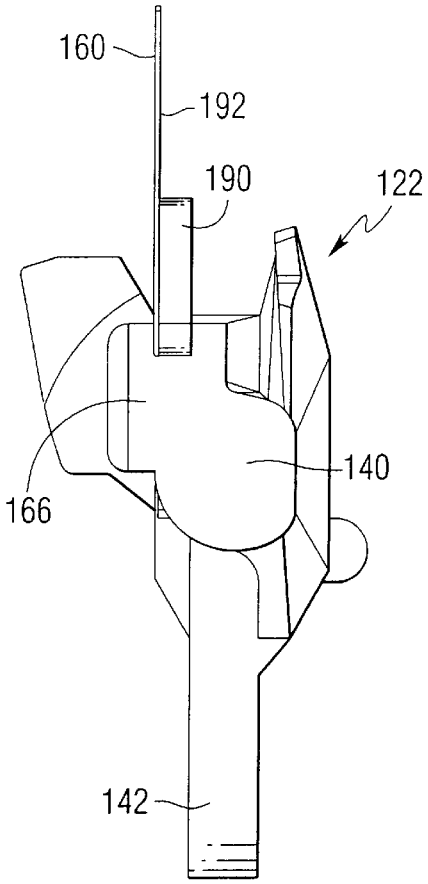
FIG. 10A is an orthogonal side view of the trip bar assembly of the circuit interrupter of FIG. 1.
Figure 10B:
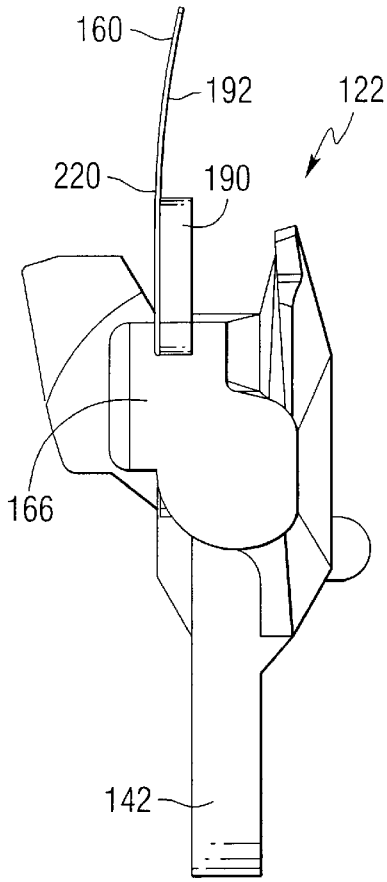
FIG. 10B is another orthogonal side view of the trip bar assembly with an accessory trip lever bent to the right.
Figure 10C:
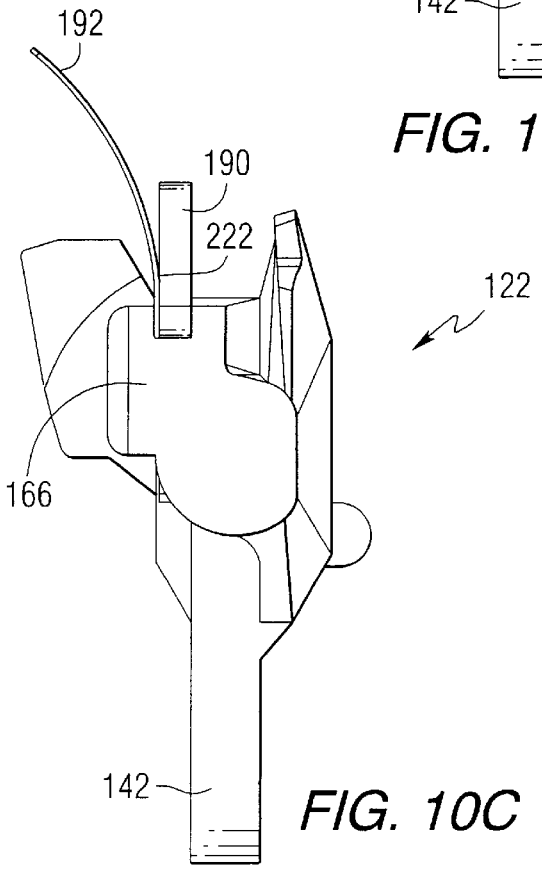
FIG. 10C is another orthogonal side view of the trip bar assembly with an accessory trip lever bent to the left.

The attachment of an accessory trip lever 148 to an attaching structure 166 enables lever 148 to cause a clockwise rotation of trip bar assembly 122 (when viewed in FIG. 3) when contact surface 160 is contacted by one of the above-described accessory devices during an accessory tripping operation. Referring now also to FIGS. 10A, 10B, and 10C, FIG. 10A shows a side view of a completely assembled trip bar assembly 122 without the application of any external forces thereon. When contact surface 160 is first contacted by an accessory device, upper lever portion 192 may slightly bend to the right at an upper bending moment 220 located along the length of portion 192 substantially at the point where it contacts the top of head 198 of lower lever position 190, as shown in FIG. 10B. However, the position of upper bending moment 220 makes upper lever portion 192 sufficiently rigid such that further force exerted upon contact surface 160 causes rotation of trip bar assembly 122 which, in turn, initiates a tripping operation.

In order to accommodate for an aforementioned obstruction of an accessory trip lever 148, and yet enable trip bar assembly 122 to continue to sufficiently rotate in the clockwise direction during a tripping operation, trip lever 148 is capable of more substantial bending than that shown in FIG. 10B. In particular, referring to FIG. 10C, when an obstruction occurs, upper 30 lever portion 192 bends to the left at a lower bending moment 222 located along the length of portion 192 substantially at the point where it contacts attaching structure 166. Because bending moment 222 is positioned lower along the length of upper lever portion 192 than upper bending moment 220 (FIG. 10B), portion 192 is afforded greater flexibility when bent to the left than when bent to the right, thereby allowing trip bar assembly 122 to continue to sufficiently rotate in the clockwise direction during a tripping operation notwithstanding an obstruction.

As described above, accessory trip lever 148 of the present invention is designed to be sufficiently rigid when force is applied to it in a rightward direction (as viewed in FIG. 10B) and sufficiently flexible when force is applied to it in a leftward direction (as viewed in FIG. 10C). The positioning of lower lever portion 190 relative to upper lever portion 192, and the material used for and thickness of upper lever portion 192, are appropriately selected in order to provide this desired functionality.

Although the preferred embodiment of the present invention has been described with a certain degree of particularity, various changes to form and detail may be made without departing from the spirit and scope of the invention as hereinafter claimed.

What is claimed is:

1. A circuit interrupter comprising:

a housing;

separable main contacts within said housing;

an operating mechanism within said housing and interconnected with said separable main contacts; and a trip mechanism within said housing and including a rotatable trip bar assembly that, when rotated, generates a tripping operation causing said operating mechanism to open said separable main contacts, said rotatable trip bar assembly including an attaching structure having a cavity into which an accessory trip member is inserted, said accessory trip member causing said rotatable trip bar assembly to rotate and generate said tripping operation when said accessory trip member is moved in a first direction, said accessory trip member including a lower portion and an upper portion positioned partially adjacent to said lower portion, said upper portion extending a greater distance away from said attaching structure than said lower portion, said lower portion including a protrusion that inserts through an opening in said upper portion, said cavity including a recess into which said protrusion then inserts when said accessory trip member is inserted into said cavity.

2. The circuit interrupter as defined in claim 1 wherein said lower portion is positioned to generate a first bending moment in said upper portion when said upper portion is moved in said first direction and a second bending moment in said upper portion when said upper portion is moved in a second direction opposite of said first direction.

3. The circuit interrupter as defined in claim 2 wherein said first bending moment is positioned further away from said attaching structure than said second bending moment.

4. The circuit interrupter as defined in claim 1 wherein said accessory trip member includes leg portions that are inserted into and extend past said cavity and that are bent to abut portions of said rotatable trip bar assembly and thereby prevent said accessory trip member from being removed from said cavity.

5. The circuit interrupter as defined in claim 4 wherein said attaching structure includes a shoulder and said accessory trip member includes a ledge that abuts said shoulder upon full insertion of said accessory trip member into said cavity.

6. A circuit interrupter comprising:

a housing;

separable main contacts within said housing;

an operating mechanism within said housing and interconnected with said separable main contacts; and a trip mechanism within said housing and including a rotatable trip bar assembly that, when rotated, generates a tripping operation causing said operating mechanism to open said separable main contacts, said rotatable trip bar assembly including an attaching structure including a cavity into which an accessory trip member is inserted, said accessory trip member causing said rotatable trip bar assembly to rotate and generate said tripping operation when said accessory trip member is moved in a first direction, said accessory trip member having leg portions that are inserted into and extend past said cavity and that are bent to abut portions of said rotatable trip bar assembly and thereby prevent said accessory trip member from being removed from said cavity.

7. The circuit interrupter as defined in claim 6 wherein said accessory trip member comprises a lower portion and an upper portion positioned partially adjacent to said lower portion, said upper portion extending a greater distance away from said attaching structure than said lower portion, and wherein said lower portion includes said leg portions.

8. The circuit interrupter as defined in claim 7 wherein said lower portion includes a protrusion and said upper portion includes an opening through which said protrusion is inserted.

9. The circuit interrupter as defined in claim 8 wherein said cavity includes a recess into which said protrusion inserts when said accessory trip member is inserted into said cavity.

10. The circuit interrupter as defined in claim 6 wherein said attaching structure includes a shoulder and said accessory trip member includes a ledge that abuts said shoulder upon full insertion of said accessory trip member into said cavity.

* * * * *